US007308855B2

(12) United States Patent
Van Auken

(10) Patent No.: US 7,308,855 B2
(45) Date of Patent: Dec. 18, 2007

(54) RAILWAY TRUCK PEDESTAL BEARING ADAPTER

(75) Inventor: Charles L. Van Auken, Dillsburg, PA (US)

(73) Assignee: ASF-Keystone, Inc., Granite City, IL (US)

( * ) Notice: Subject to any disclaimer, the term of this patent is extended or adjusted under 35 U.S.C. 154(b) by 24 days.

(21) Appl. No.: 10/863,712

(22) Filed: Jun. 8, 2004

(65) Prior Publication Data

US 2005/0268812 A1 Dec. 8, 2005

(51) Int. Cl.
*B61F 5/26* (2006.01)

(52) U.S. Cl. ..... 105/218.1

(58) Field of Classification Search ..... 105/218.1, 105/220, 224.1, 225
See application file for complete search history.

(56) References Cited

U.S. PATENT DOCUMENTS 5,404,826 A * 4/1995 Rudibaugh et al. ..... 105/222
5,562,045 A * 10/1996 Rudibaugh et al. ..... 105/224.1

OTHER PUBLICATIONS

Letter-Mar. 1, 2001.
Letter-Jul. 19, 2002.
Letter +attachments—Jul. 21, 2003.

* cited by examiner

*Primary Examiner*—S. Joseph Morano
*Assistant Examiner*—Robert J. McCarry, Jr.
(74) *Attorney, Agent, or Firm*—Edward J. Brosius

(57) ABSTRACT

A railway car truck is provided that includes two sideframes and a bolster. Each sideframe has a pedestal opening at each end to receive a bearing adapter assembly. The bearing adapter assembly includes a cast steel bearing adapter that is formed to fit on top of a bearing assembly. An adapter pad, comprised of a selected hardness elastomer, is fit on top of the bearing adapter. Protrusions extend from the adapter pad and are received in depressions in the bearing adapter to provide longitudinal stability for the adapter pad on the bearing adapter itself.

30 Claims, 6 Drawing Sheets

RAILWAY TRUCK PEDESTAL BEARING ADAPTER

BACKGROUND OF THE INVENTION

The present invention relates to a railway freight car truck and, more particularly, to a pedestal bearing adapter for use in the pedestal jaw opening of the sideframe of a railway freight car truck.

In a railway freight car truck, two axles are held in a pair of laterally spaced sideframes, with a bolster extending laterally between and supported on each sideframe. The wheels are press fit on the axles, with the ends of the axles also fitted with a roller bearing assembly. The roller bearing assembly itself is fit into a bearing adapter that is fit into a pedestal jaw opening at the longitudinal end of each sideframe. The ends of the bolsters are themselves supported on spring groups, which are supported on the lower portion of the center openings of the sideframes.

U.S. Pat. No. 5,562,045 discloses a adapter and pad assembly useful in the fitting of the bearing assembly into the pedestal jaw opening of each sideframe. The bearing adapter, which is itself fit on top of the bearing assembly, is comprised of a unitary cast steel piece. This piece includes shoulders that are laterally spaced to form a receiving opening at each longitudinal edge of the bearing adapter. An elastomeric adapter pad is fitted on top of the bearing adapter. The adapter pad itself is disclosed to be comprised of an injection molded polymer or a castable polyurethane. The adapter pad itself includes depending legs which extend from opposite longitudinal edges of the adapter pad. The depending legs are spaced laterally at each longitudinal edge of the adapter pad such that the depending legs are received in openings between the laterally spaced shoulders of the bearing adapter. One problem with this assembly is the tendency of the adapter pad to move longitudinally across the top of the bearing adapter. This movement is exacerbated by the slight steering movement of the wheel axles in the pedestal jaw openings, such that the movement of the adapter pad completely off the bearing adapter occurs. This is an undesirable situation leading to poor performance of the railway freight car truck.

Accordingly, it is an object of the present invention to provide an improved bearing adapter and pad assembly.

It is another object of the present invention to provide an improved bearing adapter and pad assembly that eliminates the tendency of the adapter pad to move longitudinally across the top of the bearing adapter.

SUMMARY OF THE INVENTION

A railway freight car truck of the so-called three piece standard design, is comprised of two laterally spaced, unitary cast steel sideframes and a laterally extending bolster, also of a unitary cast steel structure. The ends of the bolster are received and supported on spring groups that themselves are supported on the bottom section of a bolster opening in each sideframe.

The wheel axle assemblies themselves are received in openings, commonly referred to as pedestal jaw openings, at longitudinal ends of each sideframe. The wheel axle assemblies themselves extend laterally between the sideframes, and hence, also laterally between the two spaced railway tracks. For improved performance of the railway freight car truck, it is desirable to receive the bearings press fit on each axle end into a bearing adapter assembly. The improved bearing adapter assembly of the present invention is comprised of a cast steel, unitary bearing adapter. This bearing adapter includes lateral edges themselves having arcuate cutouts to be placed over the bearing assembly. The bearing adapter further comprises depending shoulders that extend from each longitudinal edge of the bearing adapter. The shoulders at each longitudinal edge of the bearing adapter themselves are laterally spaced to form an opening there between. Further, the bearing adapter includes depressions that extend laterally and are spaced longitudinally across the top section of the bearing adapter. It should be understood that the top section of such bearing adapter is generally rectangular in structure, such that the depressions are near each longitudinal edge of the bearing adapter. These depressions can be of a general v-shape, formed by acute angle cuts into the top section of the bearing adapter, or they could be of an arcuate nature as well.

The improved adapter pad in accordance with the present invention is comprised of an improved elastomer or polymer, usually a polyurethane. Such improved adapter pad is usually formed in a casting operation, although recent improvements have allowed the improved adapter pad to also be formed in an injection molding operation. The adapter pad itself is seen to be comprised of a generally rectangular top section, with depending legs extending from each longitudinal edge thereof. The depending legs are spaced laterally on each longitudinal edge. Such depending legs are fit downwardly into the opening in the bearing adapter and abut the shoulders of the bearing adapter to provide lateral support for the adapter pad. Further lateral support is provided by raised projections extending from the top of the bearing adapter that abut lateral edges of the adapter pad. Further, the adapter pad includes laterally extending projections extending downwardly from the top section of the adapter pad. Such projections are received in the complementary depressions in the top section of the bearing adapter itself. These projections will correspond to the depressions in the bearing adapter, so it is seen that such projections may be of a general v-shape, formed by two wall sections extending downwardly at an acute angle from the lower surface of the top section. It is also seen that such projections could be of an arcuate nature, extending into complementary arcuate depressions in the top section of the bearing adapter.

The bearing adapter of the present invention has the legs extending around the thrust lugs. In addition to this the new design pad has the additional interlock on the bottom side of the adapter pad, which allows the pad to function in shear. With the proper relationship between cross section and hardness of the pad, a spring rate is designed into the elastomer material of the pad. The elastomer then allows the railway truck wheel-sets to move from a high warp stiffness position to that of radial steering position when the truck passes through curves. Once through the curve the elastomer acts as a spring to re-center the adapter to a neutral position.

DETAILED DESCRIPTION OF THE INVENTION

Figure 1:
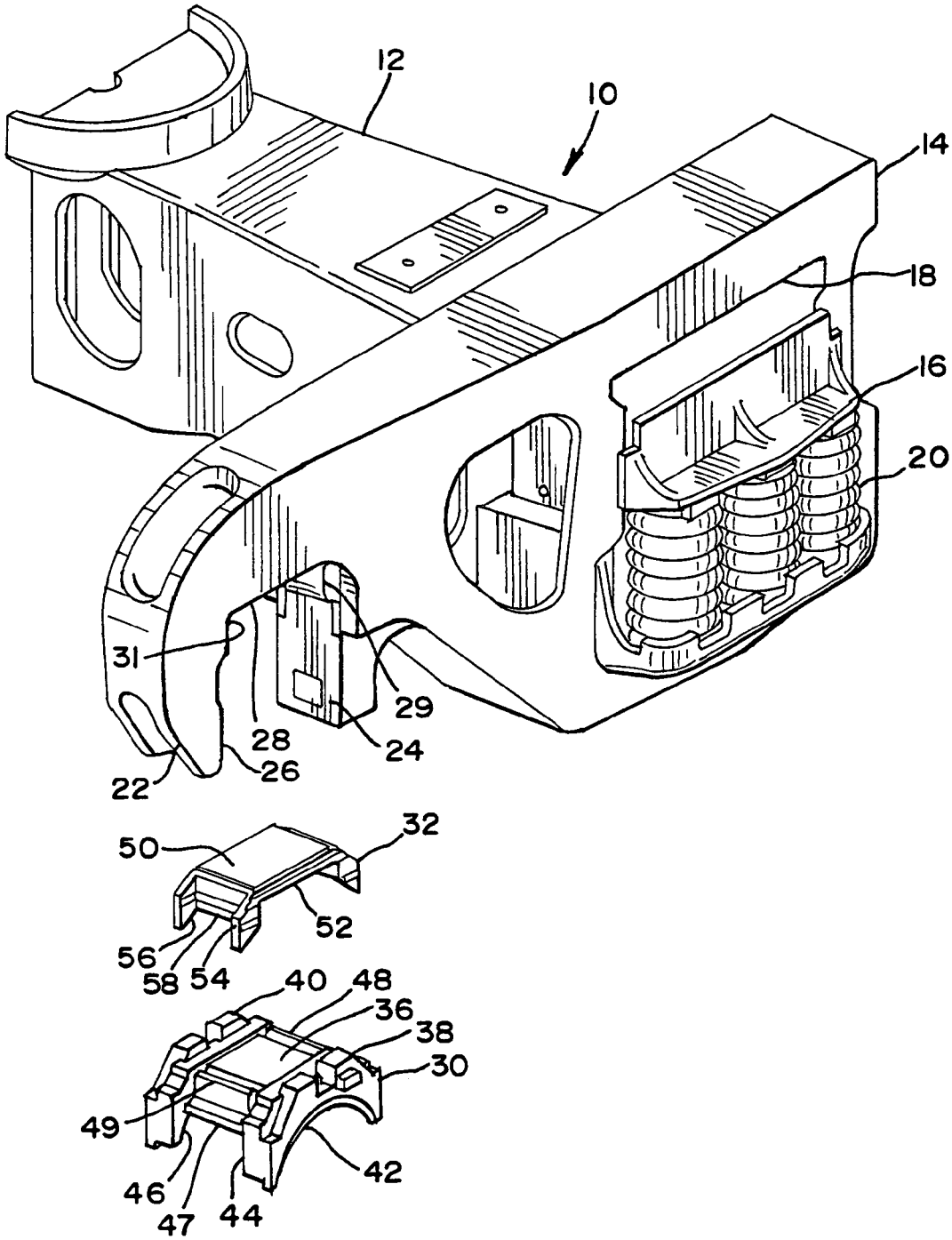
FIG. 1 is a partial perspective view of a sideframe and bolster and bearing adapter and adapter pad.

Referring now to FIG. 1 of the drawings, the lateral end of each sideframe 14 is seen to be comprised of a downwardly extending pedestal jaw 22. The inside wall 26 of pedestal jaw 22, along with roof section 28 and vertical face 24 are seen to combine to form the pedestal jaw opening. At the interface between vertical face 24 and roof section 28, there is seen to be an inner thrust lug 29. Inner thrust lug 29 is seen to comprise an angled section that extends from an upper section of vertical face 24 to an inward section of roof section 28. Similarly, but not entirely seen in this perspective view of FIG. 1, outer thrust lug 31 is seen to comprise an angled section extending from an upper portion of inside wall 26 extending to an inner portion of roof section 28.

Another part of the present invention includes bearing adapter 30, which is seen to be a generally rectangular structure having depending legs extending therefrom. Bearing adapter 30 is usually comprised of a unitary cast steel structure. Adapter pad 32 is also seen to be a generally rectangular structure with depending legs extending therefrom. Adapter pad 32 is usually comprised of a cast or injection molded polymer or elastomer, which will be further described.

Bearing adapter 30 is seen to be comprised of a unitary, cast steel structure that is generally rectangular in shape. Bearing adapter 30 is comprised of a generally rectangular top section 36, which is seen to be generally flat. Two raised edge supports 38 are seen to extend upwardly from the lateral edges of bearing adapter 30, as are similar raised edge supports 40 from the opposite lateral edge of bearing adapter 30. The combined raised edge supports 38 and 40 form a receiving surface and pocket for adapter pad 32. Bearing adapter 30 is also seen to comprise an arcuate opening 42 on each lower lateral edge; this arcuate opening 42 is adapted to seat against a bearing, which is not shown in this view. Bearing adapter 30 is also seen to comprise four depending shoulders, of which 44 and 46 are shown in this view. Depending shoulders 44 and 46 are seen to be laterally spaced, forming an opening for the adapter pad structure.

Adapter pad 32 is usually comprised of a cast polymer or elastomeric material and is of unitary structure. It is also possible to construct adapter pad 32 with a blown injection method, but casting is the preferred method of forming adapter pad 32. Adapter pad 32 is comprised of a generally rectangular and flat top section 50, with lateral edges, of which lateral edge 52 is shown. Four depending legs, of which depending leg 54 and 56 are shown in this view, are seen to extend downwardly, and form a thrust lug opening 58 there between. A similar thrust lug opening is formed on the other longitudinal edge of adapter pad 32. In assembling adapter pad 32 onto the top of bearing adapter 30, it can be seen that depending legs 54 and 56 project downwardly and are supported laterally against depending shoulders 44 and 46, respectively, of bearing adapter 30.

Referring now to FIG. 1, the partial perspective view of the main components of a railway freight car truck are shown generally at 10. Such components include bolster 12, which is generally a cast steel unitary structure, that extends laterally between two sideframes 14. Sideframes 14 are also unitary cast steel structures. Sideframes 14 are seen to extend longitudinally and parallel with the railway tracks. Each sideframe 14 includes a bolster opening 18 through which end 16 of bolster 12 extends. End 16 of bolster 12 is supported on spring group 20, with damping devices known as friction shoes, which are not shown in this view.

Figure 2:
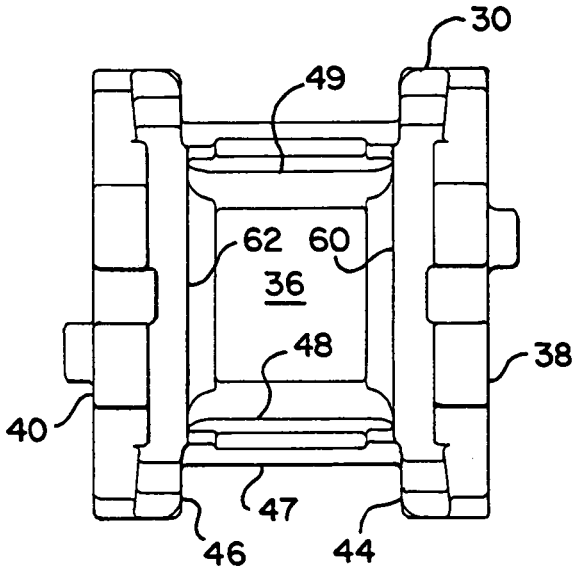
FIG. 2 is a top view of a first embodiment of a bearing adapter in accordance with the present invention.
Figure 3:
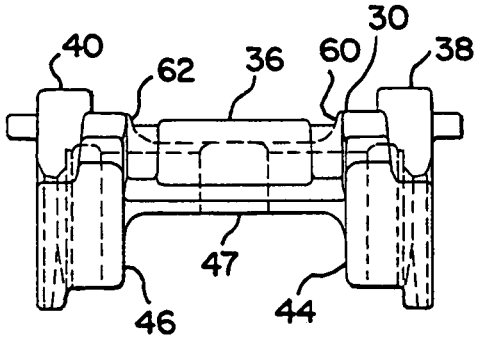
FIG. 3 is an end view of the first embodiment of a bearing adapter in accordance with the present invention.
Figure 4:
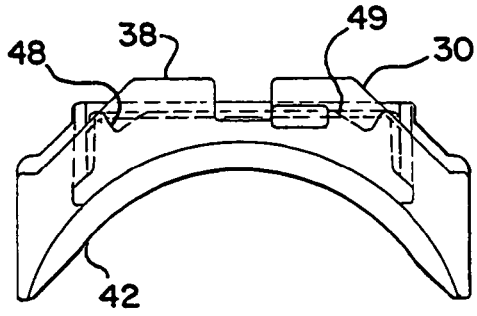
FIG. 4 is a side view of the first embodiment of a bearing adapter in accordance with the present invention.

Referring now to FIGS. 2-4, the detailed view of bearing adapter 30 shown in FIG. 1 is provided. This bearing adapter is used in a 6.5×12 size arrangement. Bearing adapter 30, as described above in FIG. 1, is seen to include a generally rectangular top section 36, with raised edge supports 38 and 40, extending upwardly from the lateral edges of bearing adapter 30. Arcuate opening 42 is also seen to be formed in lateral edges of bearing adapter 30 to allow fitting of bearing adapter 30 on top of a bearing assembly. Depending shoulders 44 and 46 are seen to extend downwardly from opposite longitudinal ends of bearing adapter 30, and depending shoulders 44 and 46 are seen to be spaced laterally from each other, forming opening 47. As shown in FIG. 1, and FIGS. 2 and 4, depressions 48 and 49 are spaced longitudinally and extend laterally across top section 36 of bearing adapter 30. Each of depressions 48 and 49 is seen to be comprised of a wall section extending downwardly from top section 36 at an acute angle therefrom. Depressions 48 and 49 are seen to extend across top section 36 to an intermediate support 60 and 62, respectively. Intermediate supports 60 and 62 are seen to extend longitudinally across top section 36 of bearing adapter 30, and are located inwardly from raised edge supports 38 and 40, respectively.

Figure 5:
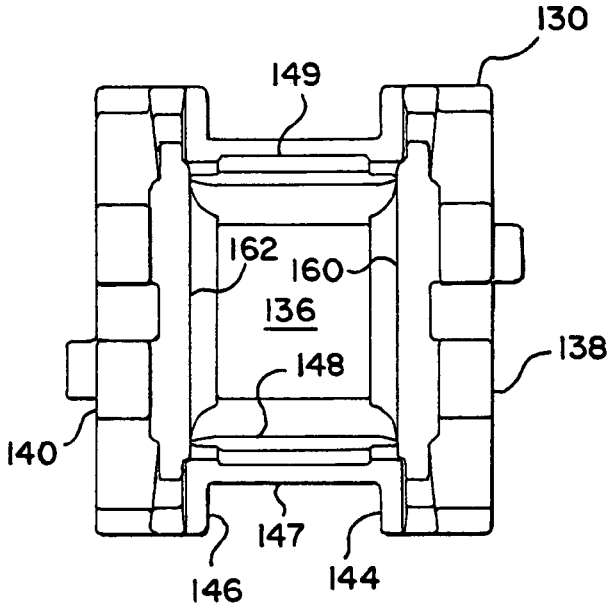
FIG. 5 is a top view of a second embodiment of a bearing adapter in accordance with the present invention.
Figure 6:
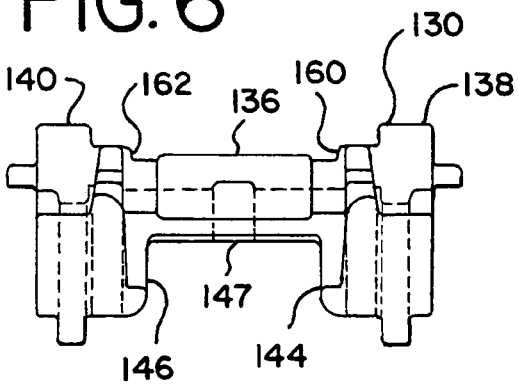
FIG. 6 is an end view of the second embodiment of a bearing adapter in accordance with the present invention.
Figure 7:
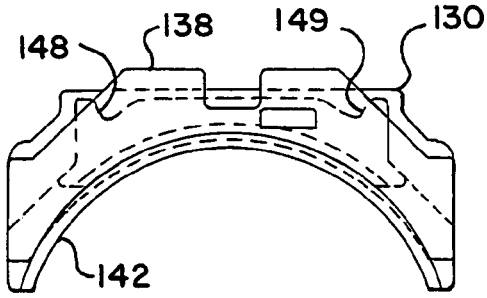
FIG. 7 is a side view of the second embodiment of a bearing adapter in accordance with the present invention.

Referring now to FIGS. 5-7, and another embodiment of bearing adapter is shown at 130. This bearing adapter is used in 6.5×9 size applications. Bearing adapter 130, as described above in FIG. 1, is seen to include a generally rectangular top section 136, with raised edge supports 138 and 140, extending upwardly from the lateral edges of bearing adapter 130. Arcuate opening 142 is also seen to be formed in lateral edges of bearing adapter 130 to allow fitting of bearing adapter 130 on top of a bearing assembly. Depending shoulders 144 and 146 are seen to extend downwardly from opposite longitudinal ends of bearing adapter 130, and depending shoulders 144 and 146 are seen to be spaced laterally from each other, forming opening 147. Depressions 148 and 149 are spaced longitudinally and extend laterally across top section 136 of bearing adapter 130. Each of depressions 148 and 149 is seen to be comprised of a wall section extending downwardly from top section 136 at an acute angle therefrom. Depressions 148 and 149 are seen to extend across top section 136 to an intermediate support 160 and 162, respectively. Intermediate supports 160 and 162 are seen to extend longitudinally across top section 136 of bearing adapter 130, and are located inwardly from a raised edge supports 140 and 138, respectively.

Figure 8:
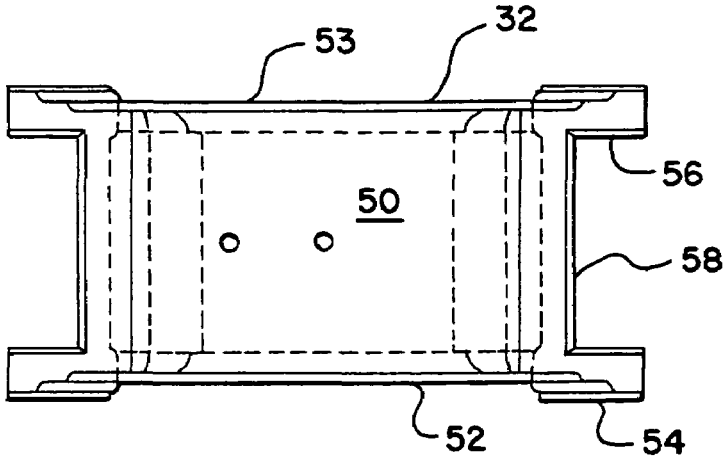
FIG. 8 is a top view of an adapter pad in accordance with the present invention.
Figure 10:
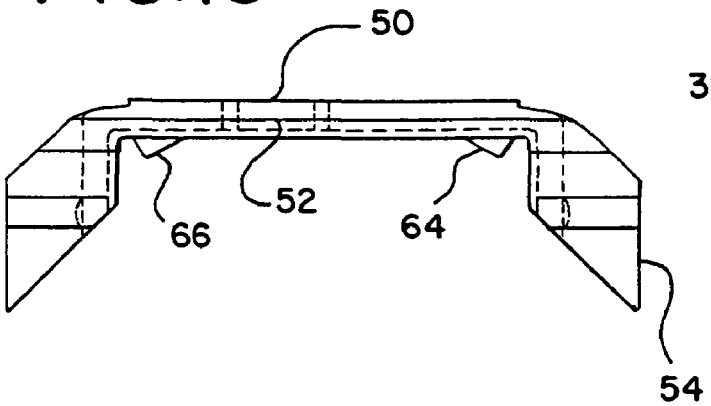
FIG. 10 is a side view of an adapter pad in accordance with the present invention.
Figure 9:
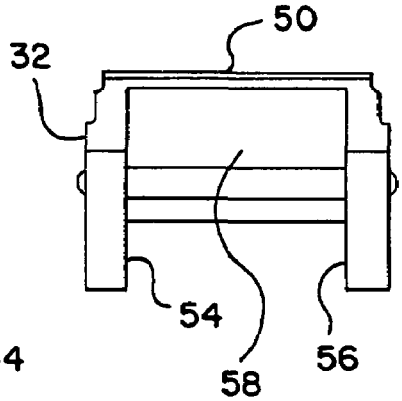
FIG. 9 is an end view of an adapter pad in accordance with the present invention.

Referring now to FIGS. 8-10, a detailed view of adapter pad 32 is provided. Adapter pad 32 is seen to be comprised of a generally rectangular top section 50. Top section 50 includes lateral edges 52 and 53. Legs 54 and 56, extend downwardly from each longitudinal edge of adapter pad 32. Legs 54 and 56 are seen to be spaced laterally so as to form thrust lug opening 58 there between. Thrust lug opening 58 and its counterpart at the other longitudinal edge of adapter pad 32 is seen to receive one of inner thrust lug 29 or outer thrust lug 31, when adapter pad 32 is fit up into roof section 28 of pedestal jaw 22.

Bearing adapter pad 32 is also seen to comprise depending protrusions 64 and 66, that extend downwardly from the bottom surface of top section 50. Protrusions 64 and 66 are seen to extend laterally across the width of adapter pad 32, extending to, or nearly to, lateral edges 52 and 53. Protrusions 64 and 66 are designed to be fit into depressions 48 and 49 in top section 36 of bearing adapter 30. Such fitting provides lateral and longitudinal stability for adapter pad 32 when fit against bearing adapter 30. Lateral stability is also provided with edges 52 and 53 of adapter pad 32 abutting raised edge supports 38 and 40, respectively, of bearing adapter 30.

Adapter pad 32 is comprised of a cast elastomer of a durometer hardness between 90A and 58D. It should be understood that it is preferred to have adapter pad 32 formed in a casting operation to obtain the desired hardness ratings, but other forming operations are possible so long as the preferred hardness ratings of adapter pad 32 are provided.

Figure 11:
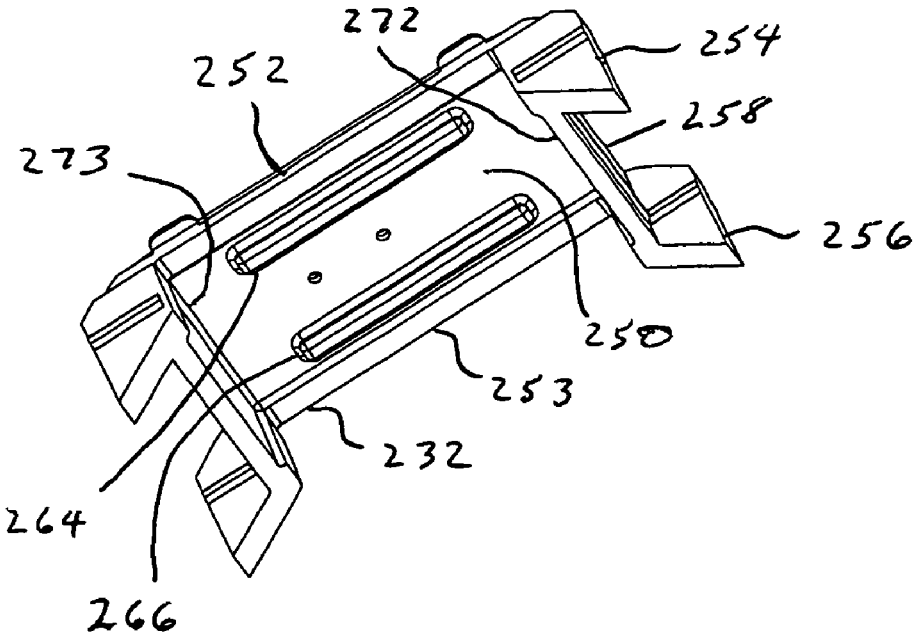
FIG. 11 is a perspective view of a third embodiment of a bearing adapter and an adapter pad in accordance with the present invention.
Figure 11:
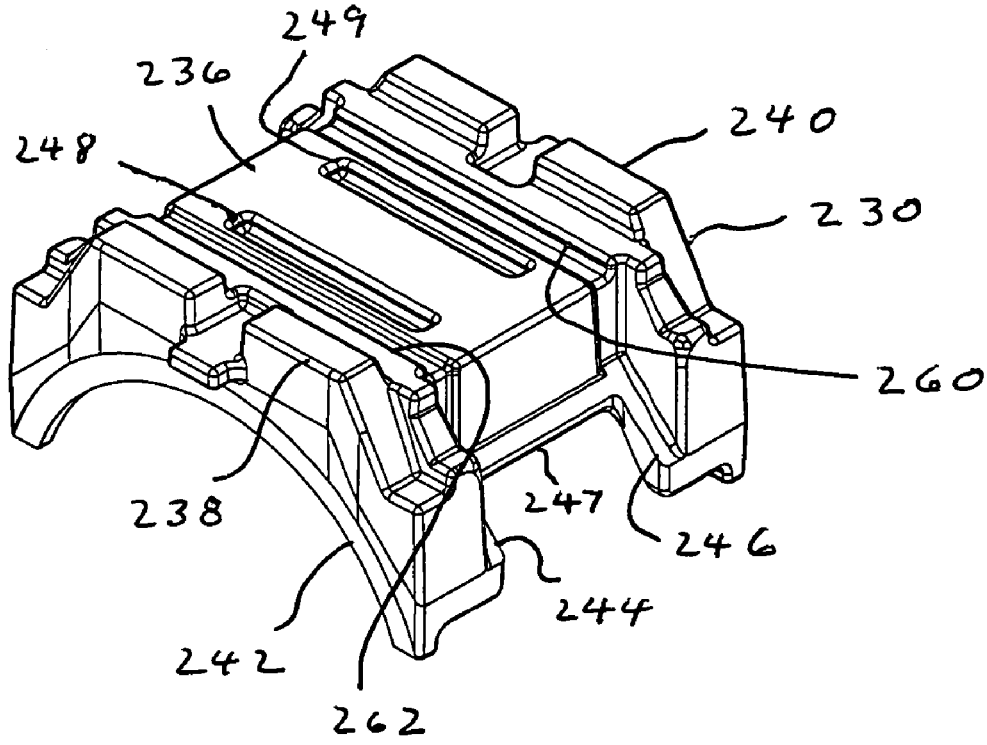

Referring now to FIG. 11, and another embodiment of bearing adapter is shown at 230. This bearing adapter is used in 6.5×9 size applications. Bearing adapter 230 is seen to include a generally rectangular top section 236, with raised edge supports 238 and 240, extending upwardly from the lateral edges of bearing adapter 230. Generally arcuate opening 242 is also seen to be formed in lateral edges of bearing adapter 230 to allow fitting of bearing adapter 230 on top of a bearing assembly. Depending shoulders 244 and 246 are seen to extend downwardly from opposite longitudinal ends of bearing adapter 230, and depending shoulders 244 and 246 are seen to be spaced laterally from each other, forming opening 247. Depressions 248 and 249 are spaced laterally and extend longitudinally across top section 236 of bearing adapter 230. Each of depressions 248 and 249 is seen to be comprised of a wall section extending downwardly from top section 236 at an acute angle therefrom. Depressions 248 and 249 are seen to extend across top section 236 adjacent and parallel to an intermediate support 260 and 262, respectively. Intermediate supports 260 and 262 are seen to extend laterally across top section 236 of bearing adapter 230, and are located inwardly from a raised edge supports 240 and 238, respectively.

Referring now to FIG. 11, a detailed view of adapter pad 232 is provided. Adapter pad 232 is seen to be comprised of a generally rectangular top section 250. Top section 250 includes lateral edges 252 and 253. Legs 254 and 256, extend downwardly from each longitudinal edge of adapter pad 232. Legs 254 and 256 are seen to be spaced laterally so as to form thrust lug opening 258 there between. Thrust lug opening 258 and its counterpart at the other longitudinal edge of adapter pad 232 is seen to receive one of inner thrust lug 29 or outer thrust lug 31, when adapter pad 32 is fit up into roof section 28 of pedestal jaw 22.

Bearing adapter pad 232 is also seen to comprise depending protrusions 264 and 266, that extend downwardly from the bottom surface of top section 250. Protru2sions 264 and 266 are seen to extend longitudinally across the length of adapter pad 232, extending nearly to the longitudinal edges 272 and 273. Protrusions 264 and 266 are designed to be fit into depressions 248 and 249 in top section 236 of bearing adapter 230. Such fitting provides lateral and longitudinal stability for adapter pad 232 when fit against bearing adapter 230. Lateral stability is also provided with edges 252 and 253 of adapter pad 232 abutting raised edge supports 240 and 238, respectively, of bearing adapter 230.

Adapter pad 232 is comprised of a cast elastomer of a durometer hardness between 90A and 58D. It should be understood that it is preferred to have adapter pad 232 formed in a casting operation to obtain the desired hardness ratings, but other forming operations are possible so long as the preferred hardness ratings of adapter pad 232 are provided.

Figure 12:
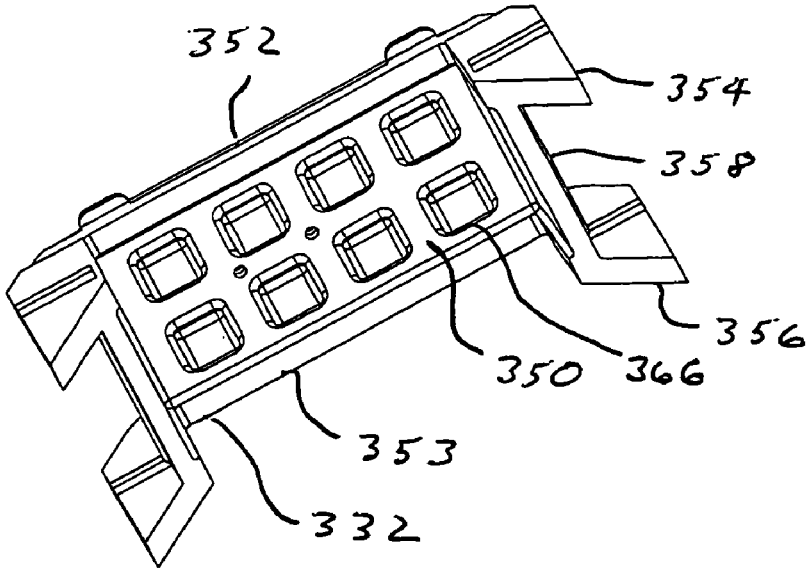
FIG. 12 is a perspective view of a fourth embodiment of a bearing adapter and adapter pad in accordance with the present invention.
Figure 12:
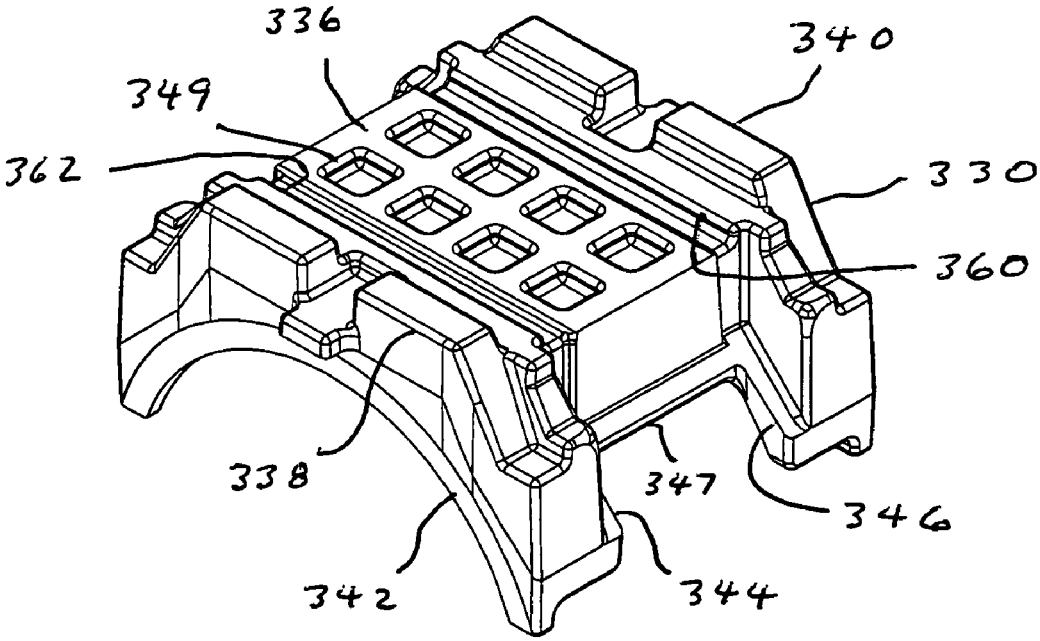

Referring now to FIG. 12, and another embodiment of bearing adapter is shown at 330. This bearing adapter is used in 6.5×9 size applications. Bearing adapter 330 is seen to include a generally rectangular top section 336, with raised edge supports 338 and 340, extending upwardly from the lateral edges of bearing adapter 330. Arcuate opening 342 is also seen to be formed in lateral edges of bearing adapter 330 to allow fitting of bearing adapter 330 on top of a bearing assembly. Depending shoulders 344 and 346 are seen to extend downwardly from opposite longitudinal ends of bearing adapter 330, and depending shoulders 344 and 346 are seen to be spaced laterally from each other, forming opening 347. A plurality of generally square shaped depressions 349 are spaced longitudinally and extend laterally across top section 336 of bearing adapter 330. Each of depressions 349 is seen to be comprised of wall sections extending downwardly from top section 336 at an acute angle therefrom. Depressions 349 are seen to be patterned across top section 336. Depression 349 could also be comprised of rounded openings or other outer shapes. Intermediate supports 360 and 362 are seen to extend longitudinally across top section 336 of bearing adapter 330, and are located inwardly from a raised edge supports 340 and 338, respectively.

Referring now to FIG. 12, a detailed view of adapter pad 332 is provided. Adapter pad 332 is seen to be comprised of a generally rectangular top section 350. Top section 350 includes lateral edges 352 and 353. Legs 354 and 356, extend downwardly from each longitudinal edge of adapter pad 332. Legs 354 and 356 are seen to be spaced laterally so as to form thrust lug opening 358 there between. Thrust lug opening 358 and its counterpart at the other longitudinal edge of adapter pad 332 is seen to receive one of inner thrust lug 29 or outer thrust lug 31, when adapter pad 332 is fit up into roof section 28 of pedestal jaw 22.

Bearing adapter pad 332 is also seen to comprise a plurality of depending protrusions 366, that extend downwardly from the bottom surface of top section 350. Protrusions 366 are spaced and extend laterally across the width of adapter pad 332. Protrusions 366 are designed to be fit into depressions 349 in top section 336 of bearing adapter 330. Such fitting provides lateral and longitudinal stability for adapter pad 332 when fit against bearing adapter 330. Lateral stability is also provided with edges 352 and 353 of adapter pad 332 abutting raised edge supports 340 and 338, respectively, of bearing adapter 330.

Adapter pad 332 is comprised of a cast elastomer of a durometer hardness between 90A and 58D. It should be understood that it is preferred to have adapter pad 332 formed in a casting operation to obtain the desired hardness ratings, but other forming operations are possible so long as the preferred hardness ratings of adapter pad 332 are provided.

What is claimed is:

1. A railway car truck comprising two sideframes and a bolster, each sideframe having a pedestal opening at each end, each pedestal opening formed by a laterally outboard pedestal jaw, a laterally inboard vertical face and a roof section extending between the pedestal jaw and the vertical face, a first thrust lug extending at the junction of the laterally inboard vertical face and the roof section, and a second thrust lug extending at the junction of an outboard vertical face and the roof section, a bearing adapter received in each pedestal opening, each bearing adapter comprising a generally rectangular center section having a top surface, a concave opening in opposite lateral end sections to receive a bearing, and a pair of laterally extending depressions in the top surface, each bearing adapter having a generally rectangular opening at opposite longitudinal end sections, each opening formed by a laterally extending adapter wall end and two laterally spaced, depending adapter shoulders, an elastomeric adapter pad mounted on top of the bearing adapter, the elastomeric adapter pad comprising a generally fiat, generally rectangular top section that extends the lateral width of the adapter pad, and two pair of depending legs that extend downwardly from each longitudinal end of the adapter pad, the adapter pad legs being spaced laterally to form a thrust lug opening at each longitudinal end of the adapter pad, a thrust lug of each sideframe pedestal opening received in the thrust lug opening of the adapter pad, the pair of adapter pad legs at each longitudinal end of the adapter pad received in the generally rectangular opening at each longitudinal end of the bearing adapter, and wherein each adapter pad further comprises a pair of laterally extending projections extending downwardly from a bottom surface of the top section of the adapter pad, and wherein the laterally extending projections from the adapter pad are received in the laterally extending depressions in the top surface of the bearing adapter.

2. The railway car truck of claim 1 wherein each of the laterally extending depressions in the top surface of the center section of the bearing adapter are formed by two acute angle side sections.

3. The railway car truck of claim 1 wherein the laterally extending projections extending downwardly from the bottom surface of the top section of the adapter pad are formed by two acute angle side sections.

4. The railway car truck of claim 1 wherein the adapter pad is comprised of a cast polymer blend of durometer stiffness, in the range of 90A to 58D.

5. The railway car truck of claim 1 wherein the adapter pad is comprised of a polymer blend and is formed in a casting operation.

6. The railway car truck of claim 1 wherein the adapter pad is comprised of a polymer blend and is formed in an injection molding operation.

7. A railway car truck comprising two sideframes and a bolster, each sideframe having a pedestal opening at each end, each pedestal opening formed by a laterally outboard pedestal jaw, a laterally inboard vertical face and a roof section extending between the pedestal jaw and the vertical face, a first thrust lug extending at the junction of the laterally inboard vertical face and the roof section, and a second thrust lug extending at the junction of an outboard vertical face and the roof section, a bearing adapter received in each pedestal opening, each bearing adapter comprising a generally rectangular center section having a top surface, a concave opening in opposite lateral end sections to receive a bearing, each bearing adapter having a generally rectangular opening at opposite longitudinal end sections, each opening formed by a laterally extending adapter wall end and two laterally spaced, depending adapter shoulders, an elastomeric adapter pad mounted on top of the bearing adapter, the elastomeric adapter pad comprising a generally flat, generally rectangular top section that extends the lateral width of the adapter pad, and two pair of depending legs that extend downwardly from each longitudinal end of the adapter pad, the adapter pad legs being spaced laterally to form a thrust lug opening at each longitudinal end of the adapter pad, a thrust lug of each sideframe pedestal opening received in the thrust lug opening of the adapter pad, the pair of adapter pad legs at each longitudinal end of the adapter pad received in the generally rectangular opening at each longitudinal end of the bearing adapter, and wherein each bearing adapter further comprises a pair of laterally extending supports extending along the top surface of the entire section, each such support located inboard from the longitudinal end sections, and wherein each adapter pad further comprises a pair of laterally extending projections extending downwardly from a bottom surface of the top section of the adapter pad, and wherein the laterally extending projections from the adapter pad are positioned to mate with the laterally extending supports in the top surface of the bearing adapter.

8. The railway car truck of claim 7 wherein each of the laterally extending supports in the top surface of the center section of the bearing adapter are formed by an acute angle side section.

9. The railway car truck of claim 7 wherein the laterally extending projections extending downwardly from the bottom surface of the top section of the adapter pad are formed by two acute angle side sections.

10. The railway car truck of claim 7 wherein the adapter pad is comprised of a cast polymer blend of a low durometer stiffness.

11. The railway car truck of claim 7 wherein the adapter pad is comprised of a polymer blend and is formed in a casting operation.

12. The railway car truck of claim 7 wherein the adapter pad is comprised of a polymer blend and is formed in an injection molding operation.

13. A railway car truck comprising two sideframes and a bolster, each sideframe having a pedestal opening at each and, each pedestal opening formed by a laterally outboard pedestal jaw, a laterally inboard vertical face and a roof section extending between the pedestal jaw and the vertical face, a first thrust lug extending at the junction of the laterally inboard vertical face and the roof section, and a second thrust lug extending at the junction of an outboard vertical face and the roof section, a bearing adapter received in each pedestal opening, each bearing adapter comprising a generally rectangular center section having a top surface, a concave opening in opposite lateral end sections to receive a bearing, each bearing adapter having a generally rectangular opening at opposite ends of the longitudinal end sections, each opening formed by a laterally extending adapter wall end and two laterally spaced, depending adapter shoulders, an elastomeric adapter pad mounted on top of the bearing adapter, the elastomeric adapter pad comprising a generally flat, generally rectangular top section that extends the lateral width of the adapter pad, and two pair of depending legs that extend downwardly from each longitudinal end of the adapter pad, the adapter pad legs being spaced laterally to form a thrust lug opening at each longitudinal end of the adapter pad, a thrust lug of each sideframe pedestal opening received in the thrust lug opening of the adapter pad, the pair of adapter pad legs at each longitudinal end of the adapter pad received in the generally rectangular opening at each longitudinal end of the bearing adapter, and wherein each bearing adapter further comprises laterally extending supports forming a pair of depressions extending along the top surface of the center section, each such depression located inboard from the longitudinal end sections, and wherein each adapter pad further comprises a pair of laterally extending projections extending downwardly from a bottom surface of the top section of the adapter pad, and wherein the laterally extending projections from the adapter pad are received in the laterally extending depressions in the top surface of the bearing adapter.

14. The railway car truck of claim 13 wherein each of the laterally extending supports in the top surface of the center section of the bearing adapter are formed by the two acute angle side sections.

15. The railway car truck of claim 13 wherein the laterally extending projections extending downwardly from the bottom surface of top section of the adapter pad are formed by two acute angle side sections.

16. The railway car truck of claim 13 wherein the adapter pad is comprised of a cast polymer blend of durometer stiffness, in the range of 90A to 58D.

17. The railway car truck of claim 13 wherein the adapter pad is comprised of a polymer blend and is formed in a casting operation.

18. The railway car truck of claim 13 wherein the adapter pad is comprised of a polymer blend and is formed in an injection molding operation.

19. A railway car truck comprising two sideframes and a bolster, each sideframe having a pedestal opening at each end, each pedestal opening formed by a laterally outboard pedestal jaw, a laterally inboard vertical face and a roof section extending between the pedestal jaw and the vertical face, a first thrust lug extending at the junction of the laterally inboard vertical face and the roof section, and a second thrust lug extending at the junction of an outboard vertical face and the roof section, a bearing adapter received in each pedestal opening, each bearing adapter comprising a generally rectangular center section having a top surface, a concave opening in opposite lateral end sections to receive a bearing, and a pair of longitudinally extending depressions in the top surface located inboard of longitudinal ends of the top surface, each bearing adapter having a generally rectangular opening at opposite longitudinal end sections, each opening formed by a laterally extending adapter wall end and two laterally spaced, depending adapter shoulders, an elastomeric adapter pad mounted on top of the bearing adapter, the elastomeric adapter pad comprising a generally flat, generally rectangular top section that extends the lateral width of the adapter pad, and two pair of depending legs that extend downwardly from each longitudinal end of the adapter pad, the adapter pad legs being spaced laterally to form a thrust lug opening at each longitudinal end of the adapter pad, a thrust lug of each sideframe pedestal opening received in the thrust lug opening of the adapter pad, the pair of adapter pad legs at each longitudinal end of the adapter pad received in the generally rectangular opening at each longitudinal end of the bearing adapter, and wherein each adapter pad further comprises a pair of longitudinally extending projections extending downwardly from a bottom surface of the top section of the adapter pad, and wherein the longitudinally extending projections from the adapter pad are received in the longitudinally extending depressions in the top surface of the bearing adapter.

20. The railway car truck of claim 19 wherein each of the longitudinally extending depressions in the top surface of the center section of the bearing adapter are formed by two acute angle side sections.

21. The railway car truck of claim 19 wherein the longitudinally extending projections extending downwardly from the bottom surface of the top section of the adapter pad are formed by two acute angle side sections.

22. The railway car truck of claim 19 wherein the adapter pad is comprised of a cast polymer blend of durometer stiffness, in the range of 90A to 58D.

23. The railway car truck of claim 19 wherein the adapter pad is comprised of a polymer blend and is formed in a casting operation.

24. The railway car truck of claim 19 wherein the adapter pad is comprised of a polymer blend and is formed in an injection molding operation.

25. A railway car truck comprising two sideframes and a bolster, each sideframe having a pedestal opening at each end, each pedestal opening formed by a laterally outboard pedestal jaw, a laterally inboard vertical face and a roof section extending between the pedestal jaw and the vertical face, a first thrust lug extending at the junction of the laterally inboard vertical face and the roof section, and a second thrust lug extending at the junction of an outboard vertical face and the roof section, a bearing adapter received in each pedestal opening, each bearing adapter comprising a generally rectangular center section having a top surface, a concave opening in opposite lateral end sections to receive a bearing, each bearing adapter having a generally rectangular opening at opposite longitudinal end sections, each opening formed by a laterally extending adapter wall end and two laterally spaced, depending adapter shoulders, an elastomeric adapter pad mounted on top of the bearing adapter, the elastomeric adapter pad comprising a generally flat, generally rectangular top section that extends the lateral width of the adapter pad, and two pair of depending legs that extend downwardly from each longitudinal end of the adapter pad, the adapter pad legs being spaced laterally to form a thrust lug opening at each longitudinal end of the adapter pad, a thrust lug of each sideframe pedestal opening received in the thrust lug opening of the adapter pad, the pair of adapter pad legs at each longitudinal end of the adapter pad received in the generally rectangular opening at each longitudinal end of the bearing adapter, and wherein each bearing adapter further comprises a plurality of depressions in the top surface, and wherein each adapter pad further comprises a plurality of laterally extending projections extending downwardly from a bottom surface of the top section of the adapter pad, and wherein the laterally extending projections from the adapter pad are positioned within the depressions in the top surface of the bearing adapter.

26. The railway car truck of claim 25 wherein each of the depressions in the top surface of the center section of the bearing adapter are formed by acute angle side sections.

27. The railway car truck of claim 25 wherein the projections extending downwardly from the bottom surface of the top section of the adapter pad are formed by acute angle side sections.

28. The railway car truck of claim 25 wherein the adapter pad is comprised of a cast polymer blend of a low durometer stiffness.

29. The railway car truck of claim 25 wherein the adapter pad is comprised of a polymer blend and is formed in a casting operation.

30. The railway car truck of claim 25 wherein the adapter pad is comprised of a polymer blend and is formed in an injection molding operation.

* * * * *